United States Patent [19]

Ettema et al.

[11] 4,308,966

[45] Jan. 5, 1982

[54] CRATES

[75] Inventors: Ernst Ettema, Hardenberg; Coenraad J. B. Benraad, Dedemsvaart, both of Netherlands

[73] Assignee: Wavin B.V., Zwolle, Netherlands

[21] Appl. No.: 127,438

[22] Filed: Mar. 5, 1980

[51] Int. Cl.[3] ..... B65D 1/24; B65D 21/02

[52] U.S. Cl. ..... 220/21; 206/511

[58] Field of Search ..... 220/21, 23.6; 206/509, 206/511, 512

[56] References Cited

U.S. PATENT DOCUMENTS

| | | | |
|---|---|---|---|
| 3,841,519 | 10/1974 | Stromberg | 220/21 |
| 3,998,328 | 12/1976 | Box | 220/21 |
| 4,249,671 | 2/1981 | Crolli | 220/21 |

FOREIGN PATENT DOCUMENTS

| | | | |
|---|---|---|---|
| 2432881 | 1/1976 | Fed. Rep. of Germany | 220/21 |
| 2718067 | 11/1978 | Fed. Rep. of Germany | 220/21 |
| 6706723 | 11/1968 | Netherlands | 220/21 |
| 951891 | 1/1963 | United Kingdom . | |
| 1222004 | 6/1968 | United Kingdom . | |
| 1232670 | 12/1968 | United Kingdom . | |
| 1342806 | 10/1970 | United Kingdom . | |
| 1297456 | 4/1971 | United Kingdom . | |

*Primary Examiner*—George E. Lowrance

*Attorney, Agent, or Firm*—Wilkinson, Mawhinney & Theibault

[57] ABSTRACT

A crate 1 for bottles with cylindrical body portions has double-skinned corner portions 7 which define with portions 13 of an internal partitioning grid 5 corner compartments 6*a* for bottles. The inner skin 12 of the corner portion is formed with vertical ribs 14 adjacent the grid portions 13. These ribs, which are interconnected with the outer skin 8 of the corner portion to form hollow columns 14*a* therewith, strength the corner portions and allow the spacing of the skins thereof to be reduced so that the size of the compartment can be increased for given external crate dimensions, and as the ribs are located adjacent the partitioning portions 13 they occupy space which would otherwise be free and do not reduce the effective size of the corner compartments.

7 Claims, 3 Drawing Figures

CRATES

This invention relates to crates, and more particularly to substantially rectangular crates for a plurality of articles, such as bottles, having cylindrical body portions.

It is known to employ double-skinned side walls in such crates to provide increased structural strength. This, however, has the disadvantage of reducing the useful interior cross-sectional area of the crate for a given external cross-sectional area thereof. This disadvantage is particularly significant where an increase in the external side dimensions of the crate is undesirable for example because the crates are required to be stackable on a pallet of given dimensions.

In order to reduce this disadvantage the present invention includes a substantially rectangular crate for a plurality of articles having cylindrical body portions, said crate having a base and side wall means and being provided with an internal partitioning grid, said side wall means including corner portions, each of which defines with adjacent mutually perpendicularly extending portions of the partitioning grid a compartment for one of said articles and includes adjacent each of said partitioning grid portions a hollow column extending vertically relative to said base.

This invention also includes a substantially rectangular crate for a plurality of articles having cylindrical body portions, said crate having a base and side wall means and being provided with an internal partitioning grid, said side wall means including double-skinned corner portions, each of which defines with adjacent mutually perpendicularly extending portions of the partitioning grid a compartment for one of said articles and comprises an outer skin having mutually perpendicular portions and an inner skin spaced from said outer skin and formed adjacent each of said partitioning grid portions with a rib extending away from the outer skin and vertically relative to said base.

It will be understood that the columns or ribs of the corner portions strengthen the corner portions, and thereby allow the spacing apart of the inner and outer skins at locations other than adjacent the grid partitioning portions to be correspondingly reduced, but by being formed adjacent the partitioning grid portions can be dimensioned so as to be spaced from the body portions of articles in the compartments of the crate.

In order that the invention may be better understood, an embodiment thereof, which is given by way of example only, will now be described, reference being had to the accompanying drawings, in which.

Figure 1:
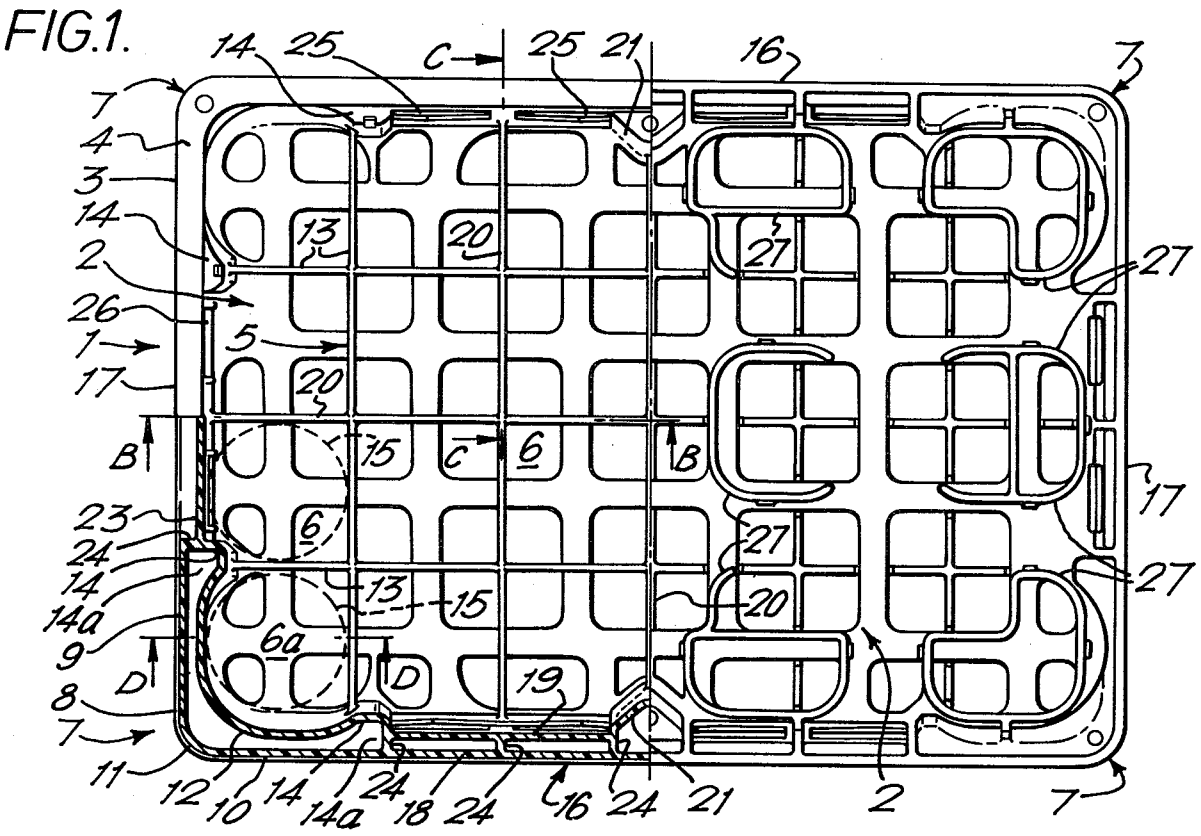
FIG. 1 shows a bottle crate, the right hand side of the Figure being a bottom plan view and the left hand side of the Figure being a part-sectioned top plan view, the section being taken along the line A—A of FIG. 2.

In the drawings there is illustrated a substantially rectangular crate 1 for a plurality of bottles (not shown) having cylindrical body portions. The crate 1 has a base 2 and side wall means 3 formed with a double-skin extending upwardly from the base to an upper rim 4 around the open top of the crate. An internal partitioning grid 5 is provided to define compartments 6 within the crate, a separate compartment being provided for each bottle.

The side wall means 3 includes double-skinned corner portions 7, best shown in the section in FIG. 1, each of which comprises an outer skin 8 having mutually perpendicular portions 9 and 10, which are interconnected in the illustrated crate by a curved portion 11, and an inner skin 12 spaced from the outer skin 8. Each corner portion 7 defines with adjacent mutually perpendicularly extending portions 13 of the partitioning grid 5 a corner compartment *6a* for one of the bottles and the inner skin 12 is formed adjacent each of these partitioning grid portions 13 with a rib 14 extending away from the outer skin 8 and vertically relative to the base 2. The ribs extend from the base 2 and terminate short of the upper rim 4. The ribs 14 are interconnected with the outer skin 8 to form hollow columns *14a* extending vertically from the base 2. In the illustrated crate, the ribs 14 of each corner portion are connected to the outer skin by stay members 24 at their remote edge portions only so that the corner portion is completely hollow. As can be seen by the circles 15 drawn in FIG. 1 to represent the cross-section of the body portions of two bottles, the provision of the ribs 14 adjacent the grid portions 13 whilst strengthening the corner portions does not decrease the effective size of the compartments since the ribs occupy space in the compartments which would be otherwise free. The strengthening effect of the ribs enables the spacing of the inner and outer skins of the corner portions to be reduced without affecting the overall strength of the corner portions, and thus the size of the compartment to be increased.

Whilst it may be advantageous to have the inner skin diverge from the outer skin away from the upper rim 4 in order to provide a more rigid structure and to facilitate moulding, the distance between adjacent corner portions available for division into compartments, may be increased, for given external crate dimensions, by making the inner skin parallel, or substantially parallel, to the outer skin at at least central vertical planes of the corner compartments. It may, however, only be required to provide this increase in one direction only, for example the direction of the longer sides of the crate, and as shown in the illustrated crate this can be achieved by making the inner skin parallel to the outer skin at the central vertical plane extending through the shorter sides of the crate only—the plane D—D of compartment *6a* in FIG. 1.

The strength of the corner portions can advantageously be further increased as shown in the illustrated crate by curving the inner skin 12 opposite the curved portion 11 of the outer skin with a greater radius and over a greater extent than the portion 11 to increase the spacing of the skins. Again, it will be appreciated that this does not decrease the effective size of the corner compartments.

The side wall means include double-skinned side wall portions which extend between the corner portions 7, the longer and shorter side wall portions being referenced 16 and 17 respectively in the drawings. These side wall portions comprise outer and inner skins 18 and 19 respectively. The partitioning grid 5 includes portions 20 which extend towards the side wall portions and in view of the foregoing description it will be appreciated that the side wall portions may be strengthened by the formation of ribs, similar to ribs 14, adjacent one or more of the grid portions 20. In the illustrated embodiment one such rib 21 is formed in each of the longer side wall portions 16 midway therealong.

Openings 22 extending through the side wall means 3 form handles for the crate and apart from these openings 22 and recesses 23 formed above them the exterior of the crate formed by the outer skins 8 and 18 is smooth and continuous. The inner skins 12 of the corner portions 7 are also continuous but the inner skins 19 of the side wall portions which are also connected to the outer skins 18 thereof by stay members 24 extending therebetween and strengthening the construction of the side wall portions, are apertured. The inner skins of the longer side wall portions are shown having substantially rectangular apertures 25 extending between top and bottom strips of the side wall portions such that the longer side wall portions are continuously double-skinned at their top and bottom. The inner skins of the shorter side wall portions are provided with apertures 26 shown extending from the bottom of the inner skins and terminating short of openings 22. The formation of apertures 25 and 26 provides a substantial saving in material and is possible without weakening the construction of the side wall portions a significant amount.

Figure 2:
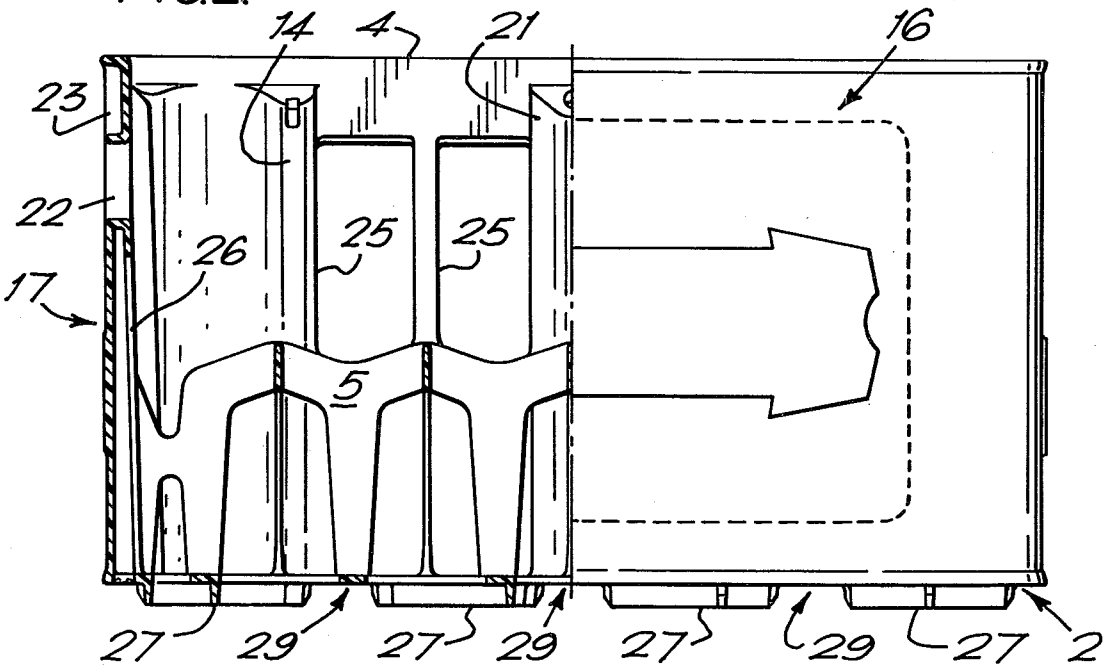
FIG. 2 is a part-sectioned side elevation of the same crate, the section being taken along the line B—B of FIG. 1.
Figure 3:
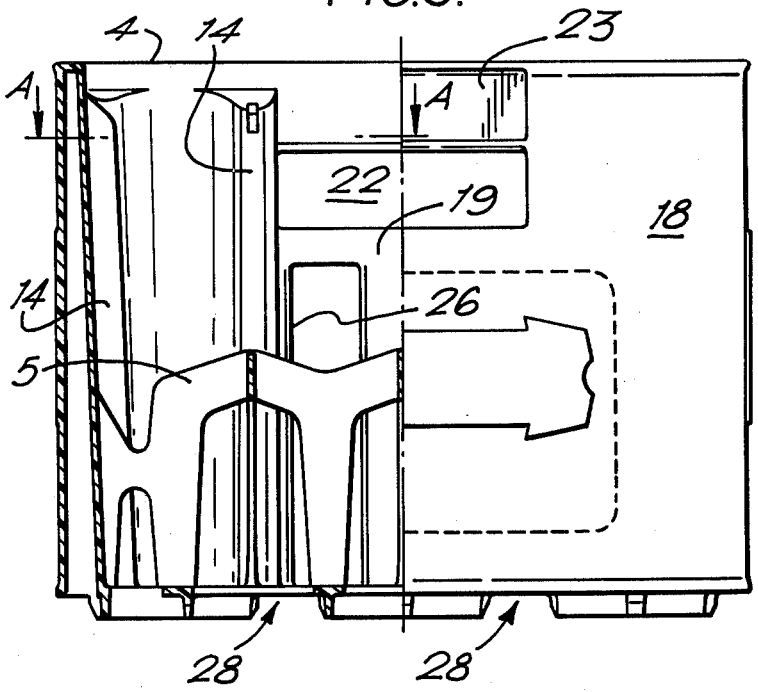
FIG. 3 is a part-sectioned end elevation of the same crate, the section being taken along the line C—C of FIG. 1.

The base 2 of the crate is also apertured and shown as a lattice grid which is provided with a plurality of downwardly extending formations 27 shown as arranged in three rows and four columns, adjacent rows and columns of the formations defining therebetween respective channels 28 (FIG. 3) and 29 (FIG. 2). Each channel is of a width such that the upper rims 4, which as will be noted from FIG. 1 are of substantially uniform thickness, of adjacent side wall portions of two similar crates arranged side-by-side and in stacked relationship with the crate can be located therein. This provision enables the crates to be stacked other than in direct vertical alignment and provides for stable stacking.

As can be best appreciated from FIG. 1, the ribs 14 of corner portions are adjacent the sides of channels 28 and the outer ones of channels 29 and the ribs 21 of the longer side wall portions are located centrally in the intermediate channel 29. Accordingly when stacked in the manner described above the adjacent upper rims of side-by-side lower crates located in a channel 28 or 29 extend close to or directly under a rib 14 or 21 at each end of the channel. This provision enables the crates in the lowest layer of a stack to carry the load of the stack better.

The illustrated crate is injection moulded in a plastics material with the partitioning grid 5 integral with the side wall means.

I claim:

1. A substantially rectangular crate for a plurality of articles having cylindrical body portions, said crate having a base and side wall means and being provided with an internal partitioning grid said side wall means defining an upper rim of the crate of substantially uniform thickness and said base being provided with a plurality of downwardly extending formations defining therebetween channels for locating the rims of adjacent side wall portions of the side wall means of two similar crates arranged side-by-side and in stacked relationship with said crate, said side wall means including double-skinned corner portions, each of which defines with adjacent mutually perpendicularly extending portions of the partitioning grid a compartment for one of said articles and comprises an outer skin having mutually perpendicular portions and an inner skin spaced from said outer skin and formed adjacent each of said partitioning grid portions with a channel shaped rib extending away from the outer skin and vertically relative to said base, said side wall means further including double-skinned side wall portions which comprise spaced outer and inner skins and extend between said corner portions, further portions of said grid extending perpendicularly towards the inner skins of said side wall portions, each of at least the longer side wall portions having its inner skin formed adjacent at least one of said further grid partitioning portions with a channel shaped rib extending away from the outer skin thereof and vertically relative to the base, and the channel-shaped ribs of the side wall means are aligned substantially with said channels such that rims of adjacent side wall portions of two similar crates arranged side-by-side located in any one of said channels of said crate extend substantially under a said channel-shaped rib at each of such a channel.

2. A crate as claimed in claim 1, wherein inner skins of the longer side wall portions are formed with a said channel-shaped rib aligned directly over a said channel such that rims of adjacent side wall portions of two similar crates arranged side-by-side located in said channel extend directly under said ribs.

3. A crate as claimed in claim 1, wherein the ribs of each corner portion are connected to the outer skin at their remote edge portions only so that said corner portion is completely hollow.

4. A crate as claimed in claim 1, wherein the inner skin of each corner portion is substantially parallel to the outer skin thereof at at least one of the central vertical planes of each compartment associated with said corner portion.

5. A crate as claimed in claim 1, wherein the inner skins of said side wall portions are apertured.

6. A crate as claimed in claim 1, wherein said side wall means includes stay members extending between its outer skins and their respective inner skins.

7. A crate as claimed in claim 1, wherein said grid partitioning is integral with said side wall means.

* * * * *